US006195021B1

(12) United States Patent
Keaveney

(10) Patent No.: US 6,195,021 B1
(45) Date of Patent: Feb. 27, 2001

(54) SMART PEDESTRIAN PUSH-BUTTON ACTUATOR FOR SIGNALIZED INTERSECTIONS

(76) Inventor: Brian Keaveney, 114 Marielle La., East Norriton, PA (US) 19401

( * ) Notice: Subject to any disclaimer, the term of this patent is extended or adjusted under 35 U.S.C. 154(b) by 0 days.

(21) Appl. No.: 09/436,369

(22) Filed: Nov. 8, 1999

(51) Int. Cl.[7] ..... G08G 1/095
(52) U.S. Cl. ..... 340/944; 200/520; 200/341
(58) Field of Search ..... 340/944; 200/520, 200/341

(56) References Cited

U.S. PATENT DOCUMENTS 3,582,876 * 6/1971 Carmack et al. ..... 340/920
4,187,418 * 2/1980 Harris ..... 200/295
5,735,492 * 4/1998 Pace ..... 246/125
5,767,465 * 6/1998 Fulton et al. ..... 200/520
5,920,050 * 7/1999 Tolman ..... 200/302.2

* cited by examiner

*Primary Examiner*—Benjamin C. Lee
(74) *Attorney, Agent, or Firm*—Duane Morris & Heckscher LLP

(57) ABSTRACT

A push button system used to actuate pedestrian timing intervals at traffic signalized locations operating using a normally closed circuit rather than a normally open circuit, such that an open circuit resulting from the common faults of such devices and systems will result in the recognition of the failure.

10 Claims, 5 Drawing Sheets

SMART PEDESTRIAN PUSH-BUTTON ACTUATOR FOR SIGNALIZED INTERSECTIONS

FIELD OF THE INVENTION

The present invention relates to devices and systems for the actuation of traffic signals, and in particular, a pedestrian push-button actuator and associated system.

DESCRIPTION OF THE RELATED ART

Traffic signals can be classified as pre-timed, semi-actuated, or fully actuated. Pre-timed traffic signals operate without regard to vehicle or pedestrian detection on a pre-determined cycle that does not vary based on traffic volume. Semi-actuated traffic signals provide a fixed service (green) time for main street traffic and provide variable service time for minor street traffic based upon recognition of vehicle or pedestrian presence on the minor street. The minor street receives service up to a programmed maximum before the signal returns to main street service (green). Fully actuated traffic signals recognize vehicle presence on all approaches and provide variable service time dependent on demand up to a programmed maximum. Fully actuated signals are programmed to dwell in one phase until actuation occurs on another phase.

Semi-actuated and fully actuated traffic signals, as discussed above, provide variable service times for traffic based upon demand. The demand is measured by the detection of vehicles through any number of well-known methods, or by the detection of pedestrians by the push of a pedestrian push-button. The time required for one vehicle to cross an intersection is typically much less (e.g. 3–5 seconds) than the time required for one pedestrian to cross an intersection (e.g. 15–25 seconds). As such, the push of a pedestrian push-button signals the electronic traffic signal controller to provide the greater amount of time necessary for a pedestrian to cross.

Vehicle detection is accomplished through various methods such as, for example, inductive loops, microwave detectors, and magnetometers. In each case, a failure in the detector results in the reading of an "open" or broken circuit, and the controller recognizes that detection is lost. Upon recognition that detection is lost, the controller provides the maximum preset green time for that phase, assuming that there is a constant demand (i.e., the signal acts as a pre-timed signal). Likewise, the failure of a pedestrian push button must be recognized and provision of appropriate pedestrian crossing time provided until the button is repaired.

Non-functioning pedestrian push buttons are not always recognized by a traffic signal controller. This is because existing pedestrian push-buttons place a call to the traffic signal controller when a circuit is "closed" by the push of the button. The button, when pushed, contacts two terminals that complete a circuit and register a signal to the controller. Unless the button fails in this closed position, for instance by being mechanically stuck, the controller does not recognize that the button has failed and does not default to "Pedestrian Recall" phasing, where adequate pedestrian timing would be provided every cycle. Typically, the following types of common push button failures are not recognized by the traffic signal controller: rusted electrical terminals, dismantled button assembly, broken underground conduit/wire, broken internal workings of button.

FIGS. 1A and 1B depict a conventional pedestrian push button device (10) which would typically be used at semi-actuated and fully actuated signalized intersections. FIG. 1A depicts a top plan view of the device (10), and FIG. 1B depicts a front elevation view of the device. The push button device (10) includes a casing (17) which is installed into a weather-proof push button assembly (not shown) using the installation threading (18). The push button device (10) also includes a push button (21), a positive terminal (11), a negative terminal (12), and a spring (13). The push button (21) is coupled to a non-conductive plate (16), which is in turn coupled to a non-conductive shaft (15) and a conductive plate (14).

The actuation (e.g. pressing by a pedestrian) of the push button (21) pushes the non-conductive plate (16), the non-conductive shaft (15), and the conductive plate (14) against the resistance of a spring (13), so that the conductive plate (14) contacts the positive terminal (11) and negative terminal (12) of the device (10) which closes the normally open circuit. The closing of the circuit sends a signal to a traffic signal coupled to the device (10), which indicates that a pedestrian requires time to cross the street. It should be noted that the spring (13) operates to return the push button (21) to its original position upon removal of the actuation (e.g. pedestrian discontinues pressing push button).

It should be noted that the above-described device (10) is in a "open" circuit configuration most of the time. In other words, the conductive plate (14) is not normally contacting the terminals (11, 12). Only when a user depresses (actuates) the push button (21) are the conductive plate (14) and the terminals (11,12) brought into contact, thereby closing the "open" circuit. As discussed above, an "open" circuit pedestrian push button device often fails to detect certain types of failures.

Therefore, there is currently a need for an improved pedestrian push button actuator which allows more efficient detection of faults.

SUMMARY OF THE INVENTION

The present invention is an apparatus comprising an actuator including at least one terminal member, the actuator having at least a first and a second position; at least one electrical contact; and, a spring coupled to the at least one terminal member, the spring urging the terminal member against the at least one electrical contact when the actuator is in the first position.

The above and other advantages and features of the present invention will be better understood from the following detailed description of the preferred embodiments of the invention which is provided in connection with the accompanying drawings.

DETAILED DESCRIPTION

The present invention is directed to a fail-safe push-button actuation system for use by pedestrians in areas controlled by traffic signals. The invention comprises a push button device that is located on or around traffic signal installations that when pushed sends a signal through the described system and registers a request for service (green time at the traffic signal) for the intended pedestrian crossing route. The fail-safe nature of the push button will yield a constant call for pedestrian time should the push-button device itself become non-functional or the described system becomes disabled.

The subject invention is a pedestrian push button for use at semi-actuated and fully actuated signalized (traffic signals) intersections. The invention will use a unique design to provide the function currently provided by existing pedestrian push-button designs. The invention differs from the current push-buttons being utilized in that the detection of a call for pedestrian service will be by the opening of a 'closed' circuit rather than the closing of an 'open' circuit.

Figure 1A:
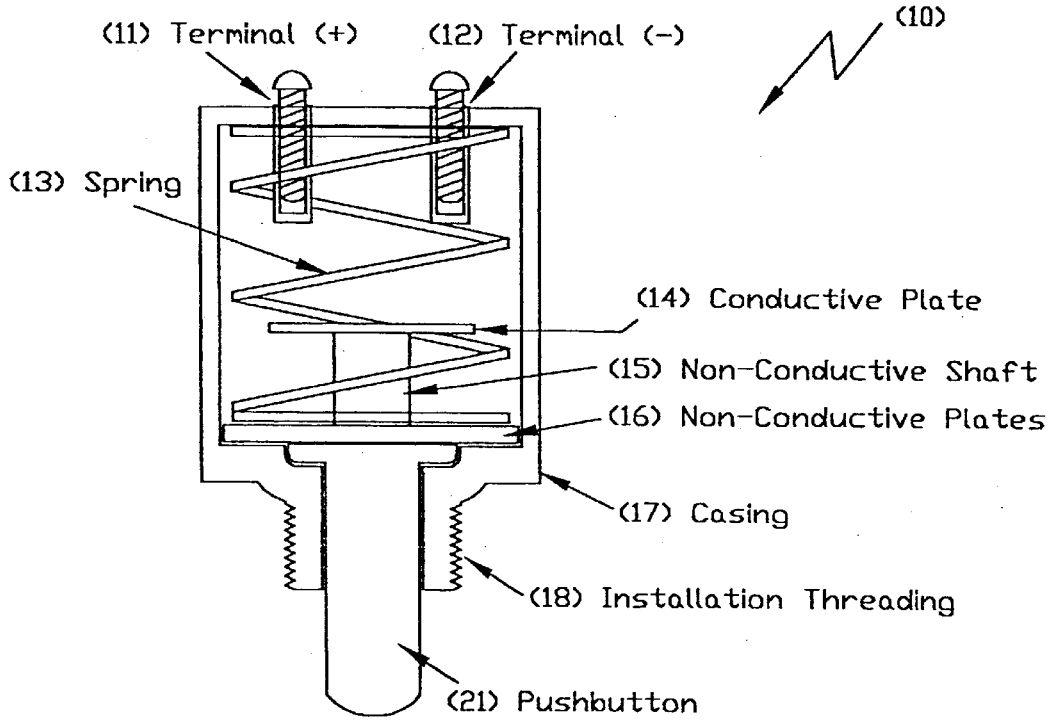
FIG. 1A is a top plan view of a conventional pedestrian push button device.
Figure 1B:
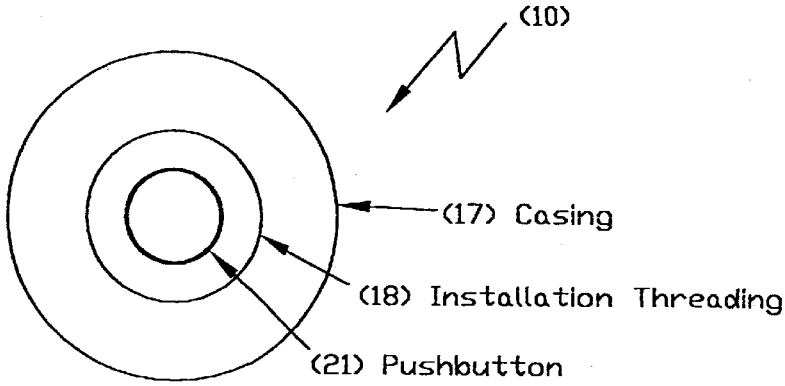
FIG. 1B is a front elevation view of the conventional pedestrian push button device shown in FIG. 1A.
Figure 2A:
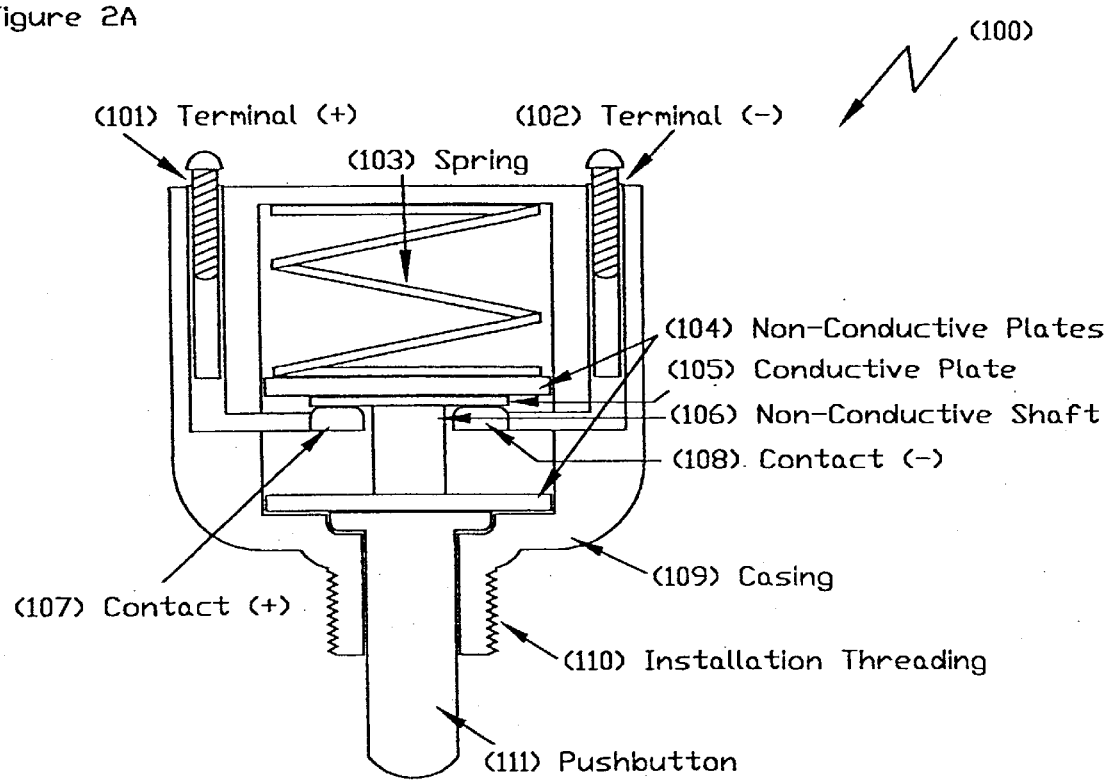
FIG. 2A is a top plan view of a pedestrian push button device according to an exemplary embodiment of the present invention, shown in its 'closed' position.
Figure 2B:
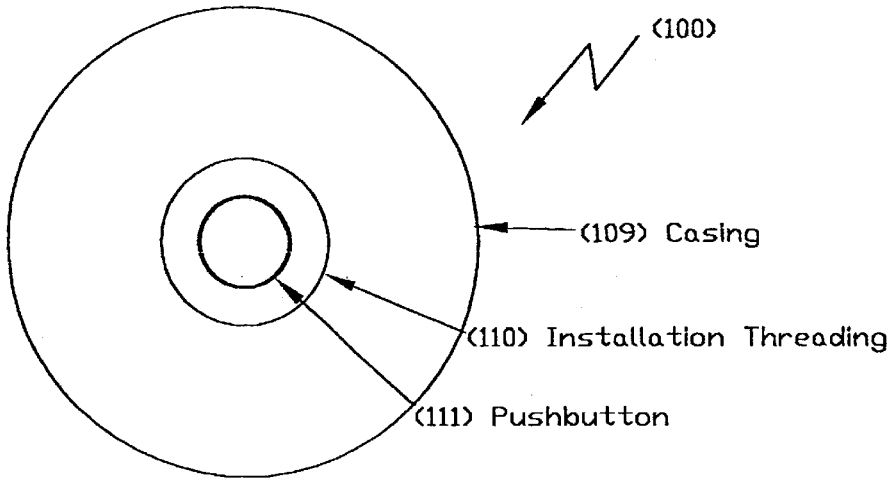
FIG. 2B is a front elevation view of the pedestrian push button device shown in FIG. 2A.

FIGS. 2A and 2B depict an exemplary embodiment of a push-button device (100) according to the present invention disposed in its "unactuated" position. As described above the push-button device (100) may be used at semi-actuated and fully actuated signalized intersections. FIG. 2A depicts a top view of the device (100) and FIG. 2B depicts a front view of the device. The push button device casing (109) is installed into a weather-proof push button assembly using the installation threading (110). In the "unactuated" position shown in FIGS. 2A and 2B, a spring (103) forces a conductive plate (105) into contact with positive and negative contacts (107, 108). The positive and negative contacts (107, 108) are in turn connected to a positive terminal (101) and a negative terminal (102) of the device (100). Thus, in the "unactuated" position, the push-button device (100) comprises a 'closed' circuit(i.e. positive terminal (101) is connected to negative terminal (102)).

Figure 2C:
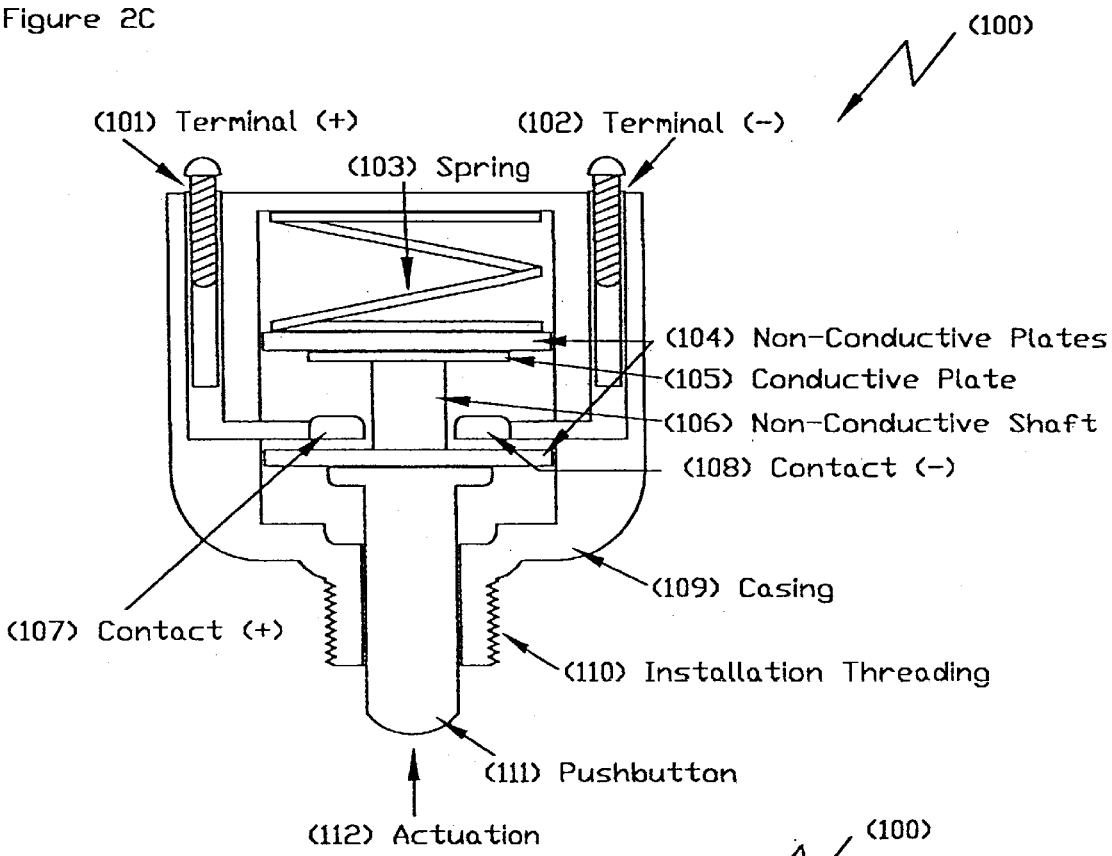
FIG. 2C is a top plan view of a pedestrian push button device according to an exemplary embodiment of the present invention, shown in its 'open' position.
Figure 2D:
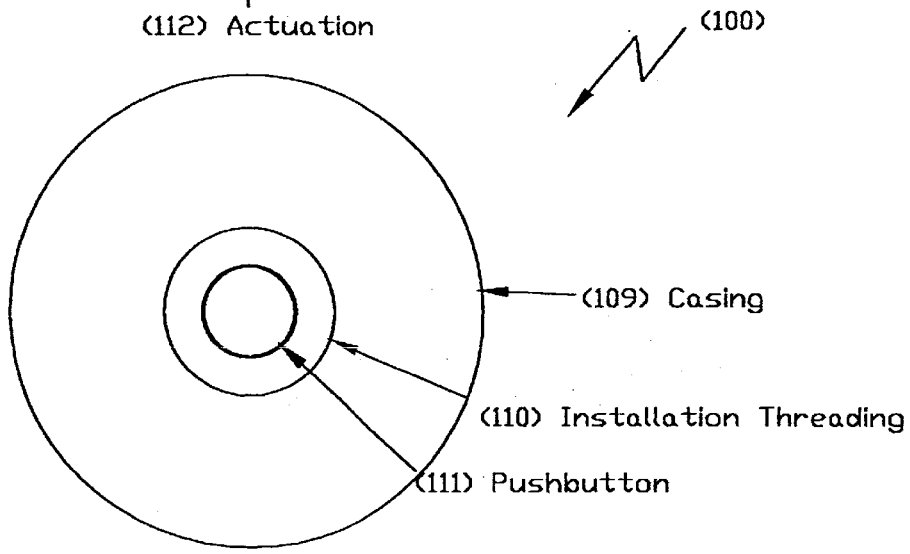
FIG. 2D is a front elevation view of the pedestrian push button device shown in FIG. 2C.

FIGS. 2C and 2D depict the push-button device (100) in its "actuated" position. FIG. 2C depicts a top view of the device (100) and FIG. 2D depicts a front view of the device. As can be seen, the actuation of the push button (111) pushes non-conductive shaft (106), non-conductive plate (104), and conductive plate (105) against the resistance of a spring (103). This action breaks the contact of the conductive plate (105) with the positive and negative contacts (107, 108) respectively connected to the positive (101) and negative (102) terminals of the device (100). The breaking of the connection sends a signal to a traffic signal coupled to the device (100), which indicates that a pedestrian requires time to cross the street. Thus, in the "actuated" position, the push-button device (100) comprises a 'open' circuit (i.e. positive terminal (101) is disconnected from negative terminal (102)). It should be noted that the spring (103) returns the push button (111) to its "unactuated" position upon release of the actuation.

Figure 3:
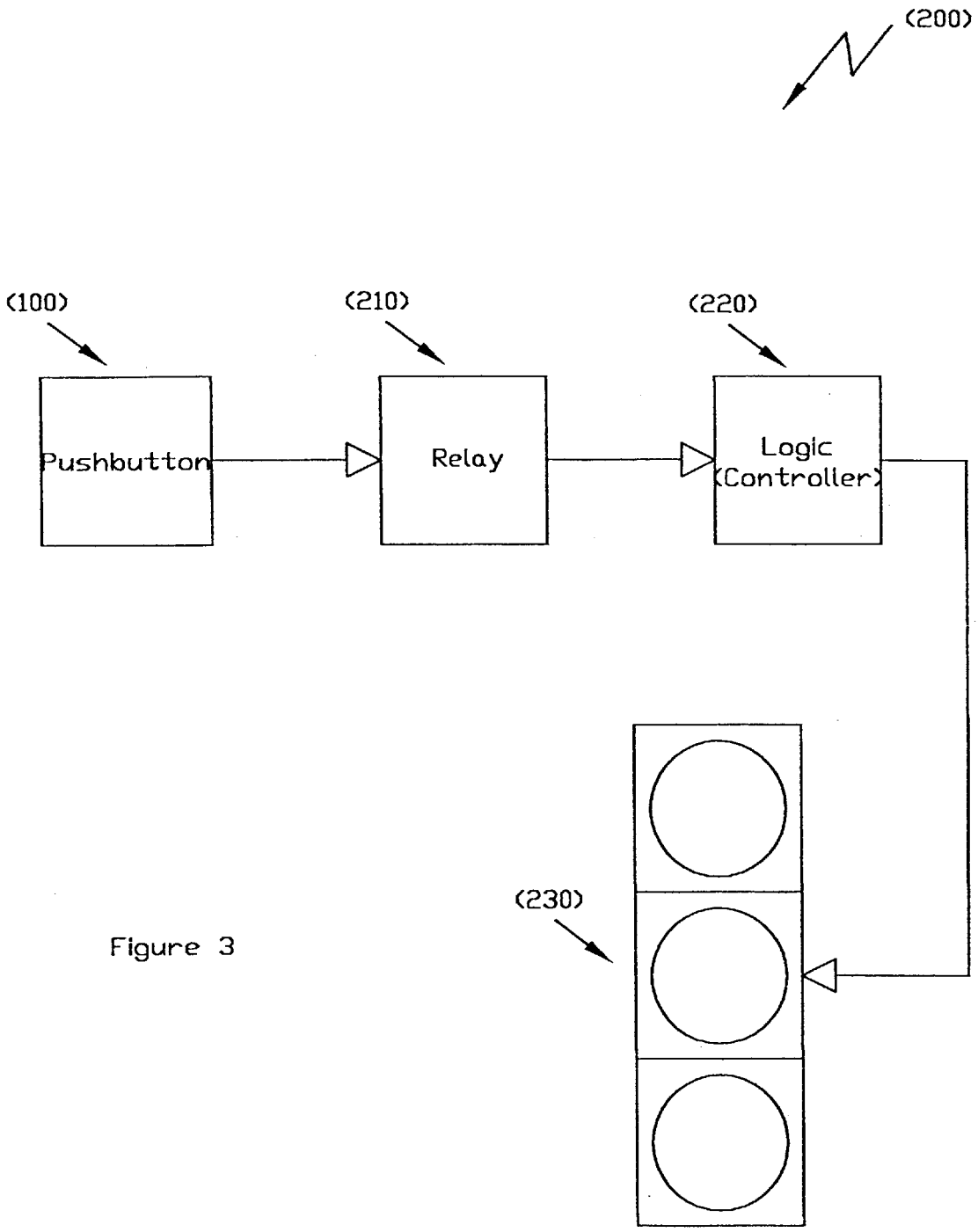
FIG. 3 is a block diagram showing a system utilizing the pedestrian push button device according to the exemplary embodiment of the present invention.
Figure 4:
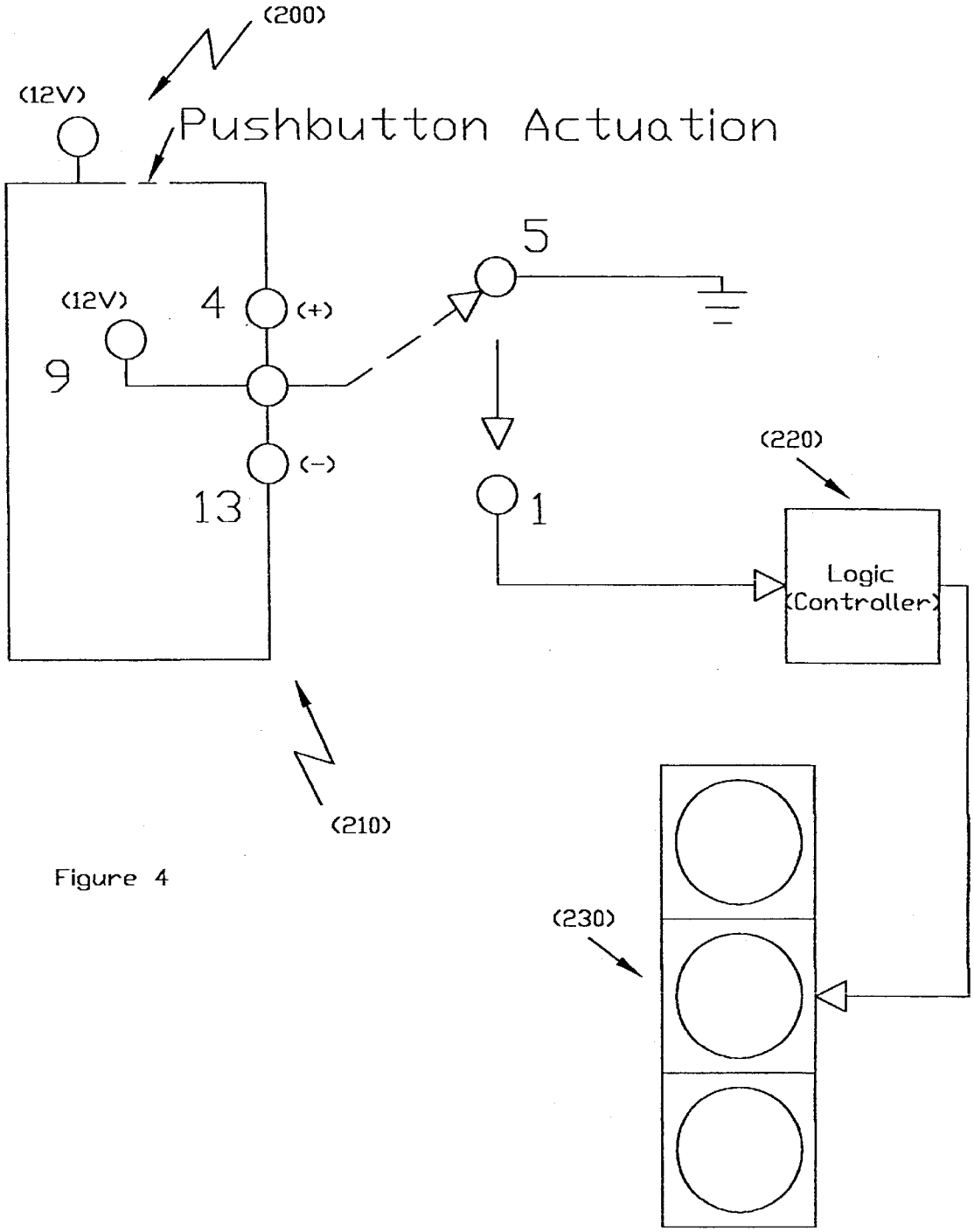
FIG. 4 is a schematic diagram showing a system and circuit utilizing the pedestrian push button device according to the exemplary embodiment of the present invention.

FIG. 3 depicts a block diagram of a system (200) includes the push-button device (100) according to the exemplary embodiment of the present invention. The actuation of the push button (111), as described above, serves to actuate a relay (210) that transmits a signal, or call for service, to a logic circuit (220) (e.g., solid state traffic signal controller), and in turn provides green indications on the appropriate traffic signal heads (230). FIG. 4 depicts the system (200) with additional detail of the intended relay (210) necessary for transmitting a signal, or call for service, to the logic circuit (220).

The pedestrian push-button device (100) according to the exemplary embodiment of the present invention is designed so that the opening of a 'closed' circuit is recognized as the call for service. This design enables the traffic signal controller to recognize more modes of failure and thereby enable "Pedestrian Recall" phasing, increasing the safety for pedestrians at signalized intersections. An opening of the circuit, for instance, between 0.01 seconds and a reasonable specified time (for example 1 minute) would place a call for the required pedestrian time for the next cycle. An open circuit, say, greater than the reasonable specified time (for example 1 minute) would place the controller into "Pedestrian recall", enabling adequate time for pedestrians to cross on every cycle until the pedestrian detection system can be repaired.

This invention is intended to replace existing push-button designs at semi-actuated and fully-actuated traffic signals. The unique design of this invention will lead to more dependable recognition of a failed push-button. Currently, push-button failures are usually only detected by the electronic traffic signal controller if the button "sticks" in a closed position. The reason that recognition of a failed pedestrian push-button is so important is that a pedestrian typically requires more time to cross an intersection, in the range of 15–25 seconds, than does a vehicle, which is in the range of 3–5 seconds per vehicle. When a push-button fails, the traffic signal controller must recognize the failure and default to what is commonly referred to as "Pedestrian Recall", and provide sufficient time for pedestrians to cross on every cycle of the signal. The controller, if "blind" to detection, must assume constant demand. If the failure of a push-button is not recognized, and vehicular detectors continue to function, it is possible that someone who has pushed the failed button will get caught in the middle of the intersection when the signal changes and services opposing traffic.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. A traffic signaling system comprising:

a traffic signal;

a signaling apparatus coupled to said traffic light, said signaling apparatus comprising an actuator including at least one terminal member, said actuator having at least a first and a second position, at least one electrical contact, and, a spring coupled to the at least one terminal member, said spring urging said terminal member against said at least one electrical contact when said actuator is in said first position.

2. The system of claim 1, wherein said actuator is a push-button actuator.

3. The system of claim 1, wherein when said actuator is in said second position the at least one electrical contact is separated from the at least one terminal member.

4. The system of claim 1, wherein the terminal member is disposed between the spring and the at least one electrical contact.

5. The system of claim 1, wherein the at least one electrical contact comprises two electrical contacts.

6. The system of claim 1, further comprising:

a housing, wherein the at least one terminal member, the at least one electrical contact, the spring, and a first portion of the actuator are disposed within the housing.

7. The system of claim 1, further comprising a logic controller coupled between the signaling apparatus and the traffic signal.

8. The system of claim 1, further comprising a relay coupled between the signaling apparatus and the traffic signal.

9. A method for controlling at least one traffic signal comprising the steps of:

providing a circuit including a traffic signal and an actuator;

maintaining the circuit in a closed circuit configuration at all times when a user has not actuated said actuator; and, creating an open circuit configuration for the circuit when the user actuates said actuator.

10. The method of claim 9, wherein when the user actuates said actuator a signal is transmitted to the traffic signal through the circuit.

* * * * *